US009365041B2

(12) United States Patent
Watanabe et al.

(10) Patent No.: US 9,365,041 B2
(45) **Date of Patent: *Jun. 14, 2016**

(54) LIQUID EJECTING HEAD AND LIQUID EJECTING APPARATUS

(71) Applicant: Seiko Epson Corporation, Tokyo (JP)

(72) Inventors: Shunsuke Watanabe, Nagano-ken (JP); Yoshinao Miyata, Nagano-ken (JP); Satoshi Oguchi, Nagano-ken (JP); Hiroaki Okui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,980

(22) Filed: May 7, 2014

(65) Prior Publication Data

US 2014/0240409 A1 Aug. 28, 2014

Related U.S. Application Data

(63) Continuation of application No. 13/671,234, filed on Nov. 7, 2012, now Pat. No. 8,757,782.

(30) Foreign Application Priority Data

Nov. 21, 2011 (JP) ..... 2011-253644

(51) Int. Cl.

| | |
|---|---|
| ***B41J 2/015*** | (2006.01) |
| ***B41J 2/175*** | (2006.01) |
| ***B41J 29/13*** | (2006.01) |
| ***B41J 2/055*** | (2006.01) |
| ***B41J 2/14*** | (2006.01) |

(52) U.S. Cl.

CPC *B41J 2/175* (2013.01); *B41J 2/055* (2013.01); *B41J 2/14233* (2013.01); *B41J 2002/14241* (2013.01); *B41J 2002/14306* (2013.01)

(58) Field of Classification Search

None

See application file for complete search history.

(56) References Cited

U.S. PATENT DOCUMENTS

| | | | | |
|---|---|---|---|---|
| 2009/0153630 | A1 * | 6/2009 | Ito et al. | 347/85 |
| 2011/0018943 | A1 * | 1/2011 | Owaki | 347/54 |
| 2011/0169897 | A1 | 7/2011 | Yokoyama et al. | |
| 2011/0205313 | A1 * | 8/2011 | Kim et al. | 347/71 |

FOREIGN PATENT DOCUMENTS

| | | |
|---|---|---|
| EP | 0903234 A2 | 3/1999 |
| JP | 2005-219243 | 8/2005 |
| JP | 2012-196771 | 10/2012 |
| JP | 2012-196882 | 10/2012 |

* cited by examiner

*Primary Examiner* — Erica Lin

(57) ABSTRACT

A liquid ejecting head comprises a unit head bonded to a communication substrate. Liquid chamber forming portions are formed in the unit case, along a first direction at positions that are separated by a partition wall. Empty liquid chamber portions and supply-side communication paths are formed in the communication substrate. The supply-side communication paths include a common communication path formed in an opposite side with a thin thickness portion left in the surface side of the communication substrate, and individual communication paths. With a surface of the partition wall and a surface of the thin thickness portion bonded together, the empty liquid chamber forming portions and the empty liquid chamber portions communicate with each other so as to define common liquid chambers.

8 Claims, 7 Drawing Sheets

LIQUID EJECTING HEAD AND LIQUID EJECTING APPARATUS

This application is a continuation of, and claims priority under 35 U.S.C. §120 on, application Ser. No. 13/671,234, filed Nov. 7, 2012, which claims priority to Japanese Patent Application No. 2011-253644 filed Nov. 21, 2011. Each such priority application is hereby expressly incorporated by reference herein in its entirety.

BACKGROUND

1. Technical Field

The present invention relates to liquid ejecting heads, such as ink jet recording heads, and to liquid ejecting apparatuses. In particular, the invention relates to a liquid ejecting head that includes a nozzle forming member in which a plurality of nozzles are provided in rows; a pressure generating unit including a pressure generator that causes pressure fluctuations in a pressure chamber; a communication member in which an empty liquid chamber portion that is to be a portion of a common liquid chamber, and a supply-side communication path that allows communication between the empty liquid chamber portion and the pressure chamber are formed; and a case member to which the communication member to which the nozzle forming member and the pressure generating unit are bonded is fixed, and to a liquid ejecting apparatus.

2. Related Art

A liquid ejecting apparatus is an apparatus that includes a liquid ejecting head and that ejects various types of liquid from the liquid ejecting head. An example of liquid ejecting apparatuses is an image recording apparatus such as an ink jet printer or an ink jet plotter. In recent years, taking advantage of being able to make a small amount of liquid accurately land at a predetermined location, liquid ejecting apparatuses have also been applied to various manufacturing apparatuses. For example, liquid ejecting apparatuses have been applied to display manufacturing apparatuses that manufacture color filters for liquid crystal displays or the like, electrode forming apparatuses that form electrodes for organic electro luminescence (EL) displays, field emission displays (FED) or the like, and chip manufacturing apparatuses that manufacture biochips. A recording head for an image recording apparatus ejects liquid ink. A color material ejecting head for a display manufacturing apparatus ejects liquid solutions of Red (R), Green (G), and Blue (B) color materials. An electrode material ejecting head for an electrode forming apparatus ejects a liquid electrode material. A living organic material ejecting head for a chip manufacturing apparatus ejects a liquid solution of a living organic material.

Some of this type of liquid ejecting head include a nozzle plate in which a plurality of nozzles are formed; a flow path forming substrate in which individual flow paths including pressure chambers that communicate with the respective nozzles, and an empty portion that is to be a portion of a common liquid chamber (also called as a reservoir or a manifold) in which a liquid common to each of the pressure chambers is stored are formed; a plurality of piezoelectric elements (a type of pressure generator) that are provided so as to correspond to the respective pressure chambers; and a common liquid chamber forming substrate in which an empty common liquid chamber portion that is to be a common liquid chamber in which the liquid common to each of the pressure chambers is to be stored is formed (see, for example, JP-A-2005-219243). In this configuration, a silicon single-crystal substrate (a type of crystalline substrate) is employed as a material of the nozzle plate or the flow path forming substrate because a flow path or the like can be formed with a high degree of precision by using an etching process. However, such a silicon single-crystal substrate is costly compared to a substrate made of synthetic resin or the like. In particular, the flow path forming substrate in which the pressure chambers are formed is fabricated by forming a plurality of flow path forming substrates on a silicon single-crystal wafer and then dividing the wafer. Therefore, it is desirable to increase the number of flow path forming substrates to be obtained by further reducing the size of the flow path forming substrate in order to achieve cost reduction.

Specifically, a configuration in which the flow path forming substrate is reduced in size by not providing the empty portion which is to be a portion of the common liquid chamber in the above-described flow path forming substrate has also been proposed.

FIGS. 7A and 7B are schematic diagrams showing an exemplary configuration of the flow path forming substrate and the like that has been reduced in size. FIG. 7A is a cross-sectional view of an essential portion of the configuration, and FIG. 7B is a plan view of the same. Note that a direction perpendicular to the view of FIG. 7A and a vertical direction in FIG. 7B are a nozzle row direction. In this exemplary configuration, a flow path forming substrate 55 in which a pressure chamber 31 is formed, a nozzle plate 57 in which a nozzle 27 is arranged, a communication substrate 59 in which a nozzle communication path 36 that allows communication between the pressure chamber 31 and the nozzle 27 is formed, and an actuator unit 64 that is provided with a piezoelectric element 62 are stacked on top of one another so as to form a head main body portion 54. In this configuration, common liquid chambers 61 are partitioned from one another and formed at a side of the head main body portion 54 by another member (in this case, a case member 65) that is made of a material other than a silicon single-crystal.

In the above-described configuration, for example, when a plurality of common liquid chambers 61 are provided for one nozzle row along the nozzle row direction in a state of being independent of one another, that is, when one common liquid chamber which is provided for one nozzle row is divided into a plurality of common liquid chambers 61, side surfaces of partition walls 66 that partition the adjacent common liquid chambers 61 from one another need to be bonded to a side surface of the head main body portion 54 using an adhesive (an area X in FIG. 7B). However, a sufficient bonded area in this portion cannot be obtained, and the side surface of the head main body portion 54 which is formed of a plurality of component members stacked on top of one another is uneven and thus a sufficient amount of adhesive cannot be poured into this portion. Therefore, ink leaks out from the bonded portion between the adjacent common liquid chambers 61.

SUMMARY

An advantage of some aspects of the invention is that it provides a liquid ejecting head that is configured to have a plurality of common liquid chambers provided for a nozzle row and that can achieve cost reduction while preventing ink leakage between the common liquid chambers, and that it provides a liquid ejecting apparatus.

A liquid ejecting head may include the following configuration: a nozzle forming member that includes a nozzle row of nozzles provided in a first direction; a pressure generating unit that includes a pressure chamber forming substrate in which pressure chambers corresponding respectively to the nozzles are formed and pressure generators that are provided so as to correspond respectively to the pressure chambers; a communication member in which nozzle communication paths that allow communication between the pressure chambers and the respective nozzles, common liquid chambers having empty liquid chamber portions respectively, and supply-side communication paths that allow communication between the empty liquid chamber portions and the pressure chambers are formed; and a case member to which the communication member and the pressure generating unit are bonded. An empty accommodating portion that accommodates the pressure generating unit and empty liquid chamber forming portions that communicate with the empty liquid chamber portions so as to define common liquid chambers are formed in the case member. The empty liquid chamber forming portions are formed along the first direction at positions that are separated from the empty accommodating portion in a second direction perpendicular to the first direction by a partition wall of the case member. The empty liquid chamber portions corresponding respectively to the empty liquid chamber forming portions are formed in the first direction. The supply-side communication paths each includes a common communication path that is formed in part by a first surface of a first portion of the communication member opposite a second surface of the first portion which second surface is bonded to the case member. The first portion of the communication member has a dimension in a thickness direction of such member that is less than a dimension of a second portion of the communication member in the thickness direction. The empty liquid chamber forming portions and the empty liquid chamber portions communicate with each other so as to define the common liquid chambers independent of each other and formed in the first direction.

Ink leakage between the common liquid chambers can be prevented, and the pressure generating unit, particularly, the pressure chamber forming substrate can be reduced in size, resulting in a reduction in the overall cost of the liquid ejecting head.

It is preferable that a configuration in which a dimension of the nozzle forming member in the second direction is smaller than a dimension of the communication member in the second direction be employed.

According to the configuration, further reduction in the size of the nozzle forming member can contribute to cost reduction.

Another feature in connection with the above-described configurations is that the empty liquid chamber portions in the communication member have openings in a third surface of the second portion of the communication member at locations separated from a bonded portion which is bonded to the nozzle forming member. The openings are sealed with a compliance member having flexibility.

According to the configuration, the compliance member can function as a compliance portion that absorbs pressure fluctuations of liquids in the common liquid chambers.

It is desirable that the pressure generating unit include a protective substrate that protects the pressure chamber forming substrate and the pressure generator.

According to the configuration, breakage of the pressure chamber forming substrate and the pressure generator can be prevented by the protective substrate.

The liquid ejecting head according to any of the above or claimed configurations may be embodied in a liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will now be described below with reference to the accompanying drawings. Although various limitations are made in the embodiment described below as preferred specific examples of the invention, it should be noted that the scope of the invention is not intended to be limited to this embodiment unless such limitations are explicitly mentioned hereinafter. In the following description, an ink jet printer (a type of liquid ejecting apparatus according to the invention) is used as an example of a liquid ejecting apparatus according to the invention.

Figure 1:
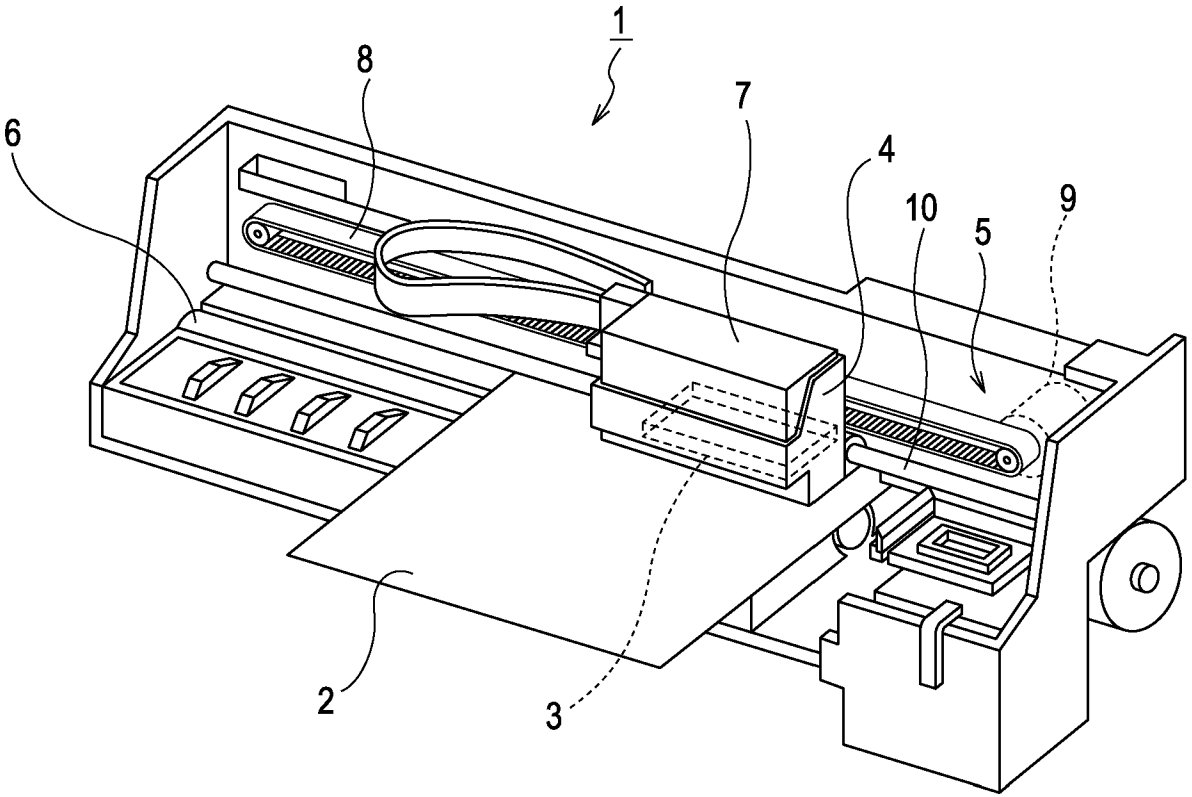
FIG. 1 is a perspective view illustrating a configuration of a printer.

A configuration of a printer 1 will be described with reference to FIG. 1. The printer 1 is an apparatus that records an image or the like by ejecting liquid ink to a surface of a recording medium 2 such as a recording sheet (a type of landing target). The printer 1 includes a recording head 3 that ejects ink, a carriage 4 in which the recording head 3 is mounted, a carriage transfer mechanism 5 that makes the carriage 4 move in a main scanning direction, and a platen roller 6 (a portion of a transport mechanism 11) that transports the recording medium 2 in a sub scanning direction. Here, the above-mentioned ink is a type of liquid according to the invention and is stored in an ink cartridge 7 that serves as a liquid supply source. The ink cartridge 7 is removably mounted on the recording head 3. Alternatively, a configuration in which the ink cartridge 7 is arranged in a main body of the printer 1 and ink is supplied from the ink cartridge 7 to the recording head 3 through an ink supply tube may be employed.

The above-described carriage transfer mechanism 5 includes a timing belt 8. The timing belt 8 is driven by a pulse motor 9 such as a DC motor. Therefore, operation of the pulse motor 9 causes the carriage 4 to be guided by a guide rod 10 that is installed across the printer 1 and to reciprocate in the main scanning direction (the width direction of the recording medium 2).

Figure 2:
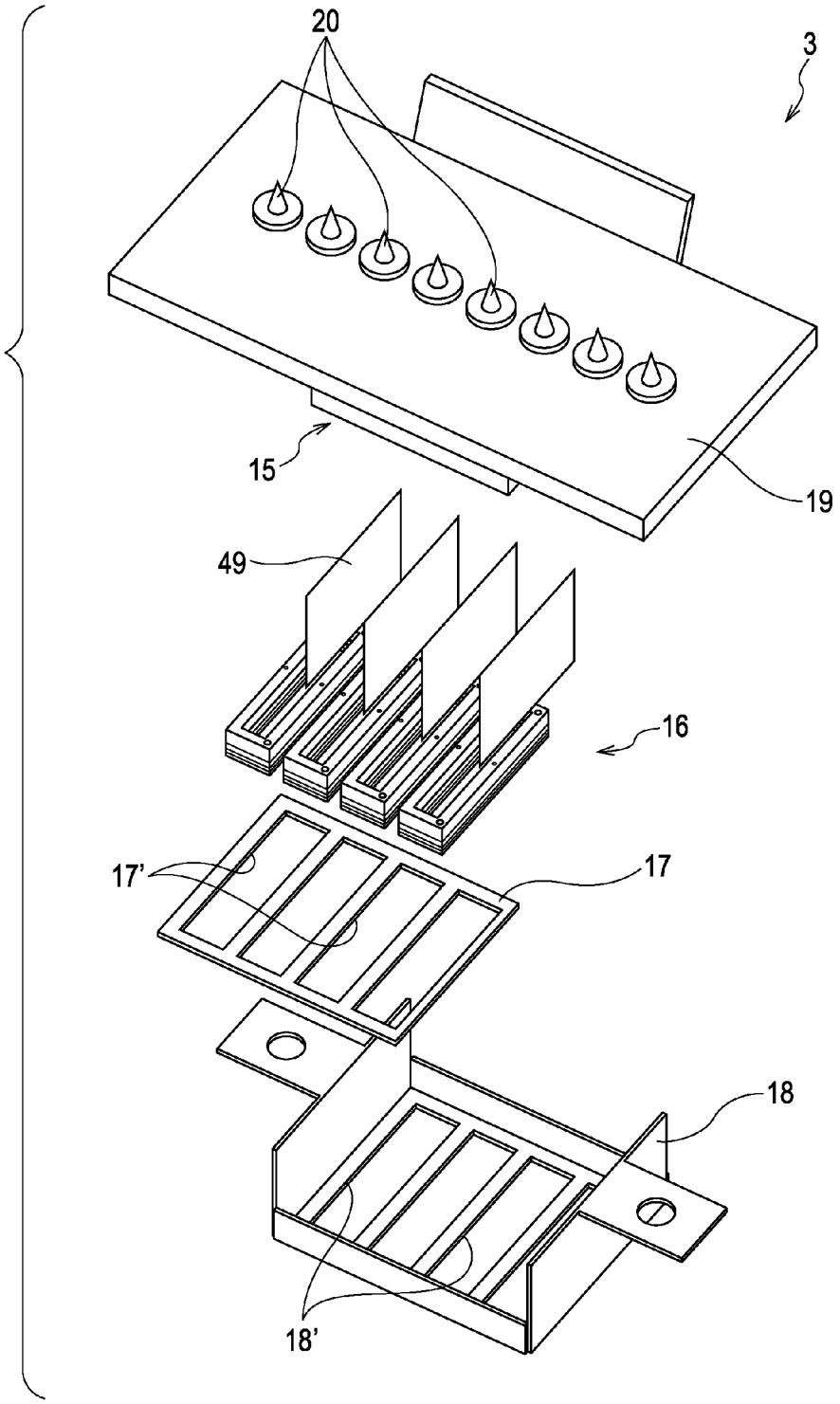
FIG. 2 is an exploded perspective view of a recording head as viewed from above.

FIG. 2 is an exploded oblique view showing a configuration of the recording head 3. The recording head 3 according to the embodiment includes a case 15, a plurality of head units 16, a metallic unit fixing plate 17, and a metallic head cover 18.

The case 15 is a box-shaped member that includes the head units 16 and supply flow paths (not shown) that supply ink to the head units 16, and a needle holder 19 is formed on the upper surface of the case 15. The needle holder 19 is a member in which ink injection needles 20 are vertically arranged. In the embodiment, a total of eight ink injection needles 20, which correspond to the different colors of inks of the ink cartridges 7, are disposed in the needle holder 19 in a horizontal row. Each of the ink injection needles 20 is a hollow needle-shaped member which is to be inserted into the corresponding ink cartridge 7. Each ink injection needle 20 injects the ink stored in the ink cartridge 7 from an injection hole (not shown) that is arranged at a tip portion of the ink injection needle 20 into the corresponding head unit 16 through the corresponding supply flow path in the case 15.

On a bottom surface side of the case 15, four head units 16 are bonded, in a state of being positioned side by side in the main scanning direction, to the unit fixing plate 17 that includes four openings 17' corresponding to the respective head units 16. In addition, the four head units 16 are fixed in place with the head cover 18 in which four openings 18' that also correspond to the respective head units 16 are arranged.

Figure 3:
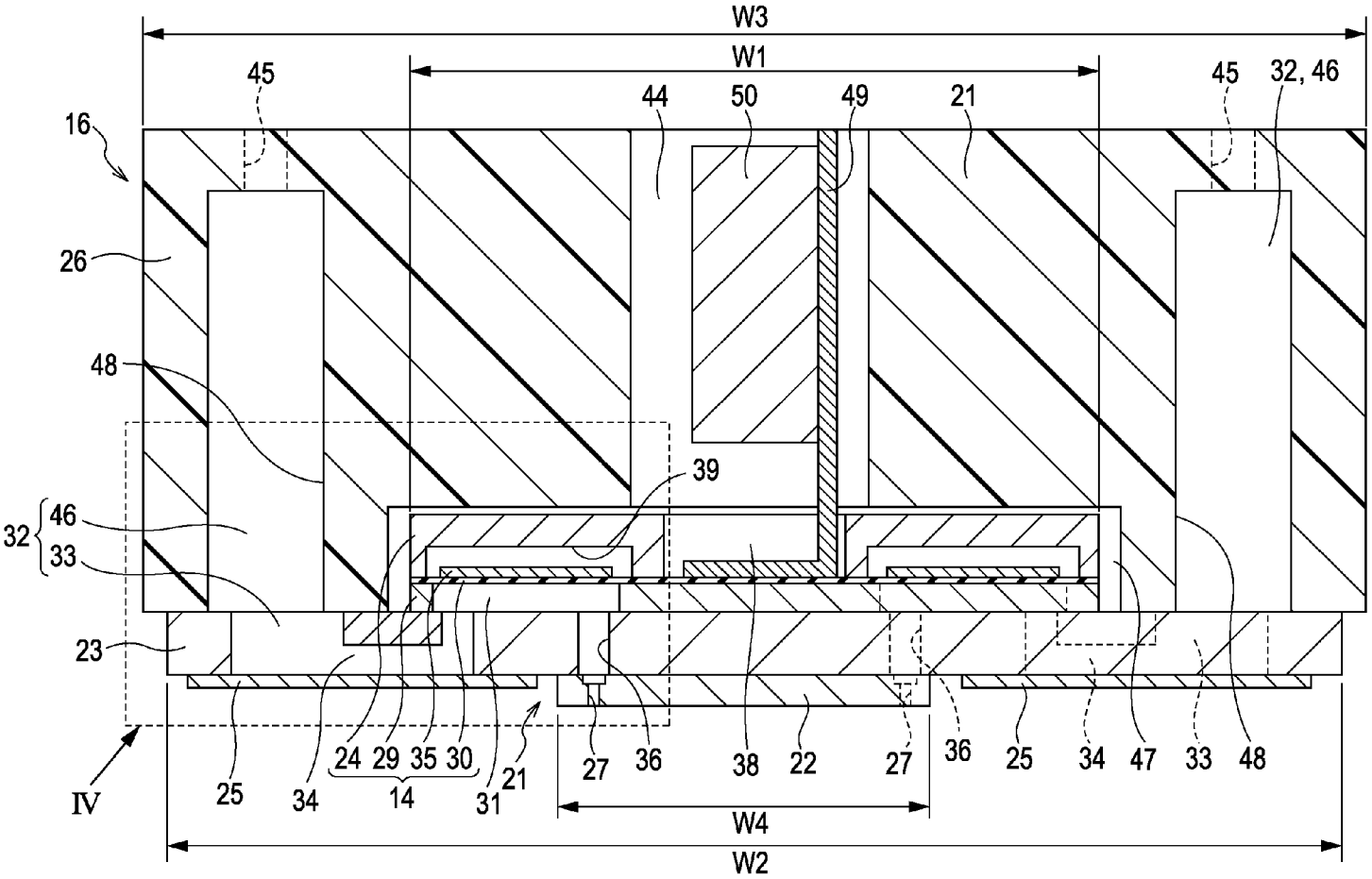
FIG. 3 is a cross-sectional view of a head unit.
Figure 4:
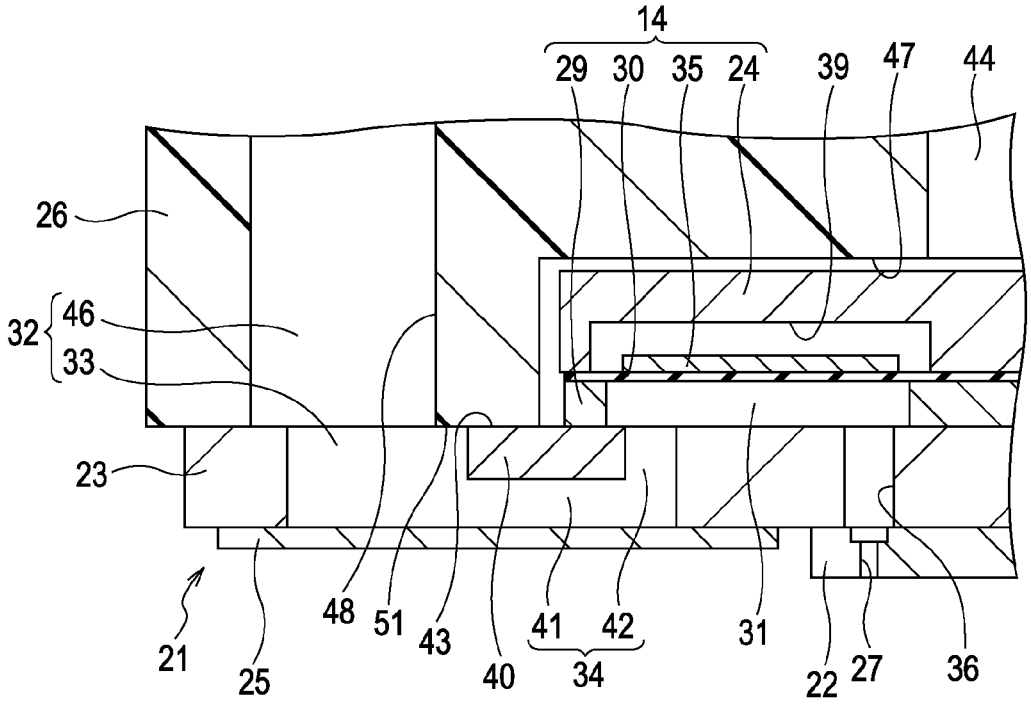
FIG. 4 is an enlarged view of an area IV in FIG. 3.

FIG. 3 is a cross-sectional view showing an internal configuration of one of the head units 16 (a type of liquid ejecting head according to the invention). FIG. 4 is an enlarged view of an area IV in FIG. 3. Note that, for convenience, a stacking direction of each member will be referred to as a vertical direction. Each of the head units 16 according to the embodiment includes a pressure generating unit 14 and a flow path unit 21, and these units are stacked one on top of the other and attached to a unit case 26 (which corresponds to a case member according to the invention). The flow path unit 21 includes a nozzle plate 22 (a type of nozzle forming member), a communication substrate 23 (a type of communication member), and a compliance sheet 25 (a type of compliance member). The pressure generating unit 14 is integrated with a pressure chamber forming substrate 29 in which pressure chambers 31 are formed, an elastic film 30, piezoelectric elements 35 (pressure generators), and a protective substrate 24 which are stacked on top of one another.

The pressure chamber forming substrate 29 that is a component member of the pressure generating unit 14 is made of a silicon single-crystal substrate (a type of crystalline substrate, hereinafter simply referred to as a silicon substrate). In the pressure chamber forming substrate 29, the pressure chambers 31 are formed by using an anisotropic etching process performed on the silicon substrate so as to correspond to nozzles 27 in the nozzle plate 22. Pressure chambers having high dimensional and form accuracy can be formed by using an anisotropic etching process performed on a silicon substrate. As will be described later, since two rows of the nozzles 27 are formed in the nozzle plate 22 according to the embodiment, two rows of the pressure chambers 31 are formed in the pressure chamber forming substrate 29 so as to correspond to the respective nozzle rows. Each of the pressure chambers 31 is an empty portion that elongates in the direction (a second direction) perpendicular to the direction (a first direction) in which the nozzles 27 are arranged side by side. When the pressure chamber forming substrate 29 (the pressure generating unit 14) is positioned on and bonded to the communication substrate 23 which is described later, a first end portion of each pressure chamber 31 in the second direction communicates with the corresponding nozzle 27 via a corresponding one of the nozzle communication paths 36 of the communication substrate 23 which is described later. A second end portion of each pressure chamber 31 in the second direction communicates with a corresponding one of the common liquid chambers 32 (empty liquid chamber portions 33) via a corresponding one of the supply-side communication paths 34 of the communication substrate 23.

The elastic film 30 is formed on an upper surface of the pressure chamber forming substrate 29 (a surface opposite a surface which is bonded to the communication substrate 23) so as to seal upper openings of the pressure chambers 31. The elastic film 30 is, for example, made of silicon dioxide and has a thickness of about 1 μm. An insulating film (not shown) is formed on the elastic film 30. This insulating film is, for example, made of zirconium oxide. The piezoelectric elements 35 are formed on the insulating film on the elastic film 30 at positions which correspond to the positions of the respective pressure chambers 31. The piezoelectric elements 35 are so-called vibration-mode piezoelectric elements. The piezoelectric elements 35 are formed by sequentially stacking a metallic lower electrode film (not shown), a piezoelectric layer (not shown) made of lead zirconate titanate (PZT) or the like, and a metallic upper electrode film (not shown) on the elastic film 30 and the insulating film, and then by patterning the stacked layers for each pressure chamber 31. One of the upper electrode film and the lower electrode film is to be a common electrode, and the other is to be an individual electrode. The elastic film 30, the insulating film, and the lower electrode film function as a vibrating plate when driving each of the piezoelectric elements 35.

Electrode wiring portions (not shown) extend from the individual electrodes (the upper electrode films) of the piezoelectric elements 35 onto the insulating film. Terminals at one end of a flexible cable 49 are connected to portions that correspond to electrode terminals of these electrode wiring portions. The flexible cable 49 has a configuration in which a conductive pattern is formed on a surface of a base film made of polyimide or the like by using copper foil or the like and is covered with a resist. A driver IC 50 that drives the piezoelectric elements 35 is mounted on the surface of the flexible cable 49. A deflection deformation occurs in each piezoelectric element 35 due to a driving signal (a drive voltage) that is applied between the upper electrode film and the lower electrode film via the driver IC 50.

The protective substrate 24 is placed on an upper surface of the pressure chamber forming substrate 29 on which the piezoelectric elements 35 are formed. The protective substrate 24 is a hollow box-shaped member having openings in a bottom surface thereof. The protective substrate 24 is made of, for example, glass, a ceramics material, a silicon single-crystal substrate, metal, or a synthetic resin. Clearance concave portions 39 are formed in areas inside the protective substrate 24 each of which faces the corresponding piezoelectric element 35. Each of the clearance concave portions 39 has such a size that driving of the corresponding piezoelectric element 35 is not obstructed. In addition, in the protective substrate 24, an empty wiring portion 38 that passes through the protective substrate 24 in the thickness direction of the protective substrate 24 is formed between the adjacent rows of the piezoelectric elements 35. The electrode terminals of the piezoelectric elements 35 and the one end portion of the flexible cable 49 are disposed in this empty wiring portion 38.

Regarding dimensions of the above-described pressure generating unit 14, at least a dimension W1 in the second direction is smaller than a dimension W2 of the communication substrate 23 and a dimension W3 of the unit case 26 in the same direction.

The above-described nozzle plate 22 is a plate-shaped member in which a plurality of nozzles 27 are arranged in rows at a pitch corresponding to a dot forming density. In the embodiment, a nozzle row is formed of three hundred and sixty nozzles 27 arranged in rows at a pitch corresponding to 360 dpi. In the embodiment, two nozzle rows are formed in the nozzle plate 22. The nozzle plate 22 according to the embodiment is made of a silicon substrate, and the nozzles 27 which are cylindrical are formed by performing dry etching on the silicon substrate. Forming the nozzles 27 by dry etching in this way enables higher precision in formation of the nozzles 27 to be obtained compared to, for example, forming nozzles by performing plastic working on a metallic plate material made of stainless steel or the like. As a result, landing precision of the inks ejected from the nozzles 27 will be improved.

Regarding dimensions of the nozzle plate 22, at least a dimension W4 in the direction (the second direction) perpendicular to the nozzle row is smaller than the dimension W1 of the pressure generating unit 14, the dimension W2 of the communication substrate 23, and the dimension W3 of the unit case 26 in the same direction. In particular, the dimension W4 is set to be as small as possible within a range in which liquid tightness between the nozzle communication paths 36 which are described later and the nozzles 27 is secured with certainty (in other words, as long as a bonding margin with which communication can be performed between each nozzle communication path 36 and the corresponding nozzles 27 in a liquid-tight state can be secured). Reducing the size of the nozzle plate 22 as much as possible in this way can contribute to cost reduction. In the case where each nozzle communication path 36 and the corresponding nozzle 27 are positioned on and communicate with each other, and the communication substrate 23 and the nozzle plate 22 are bonded together, the empty liquid chamber portions 33 and the supply-side communication paths 34 which are described later are exposed without being covered by the nozzle plate 22.

Figure 5A:
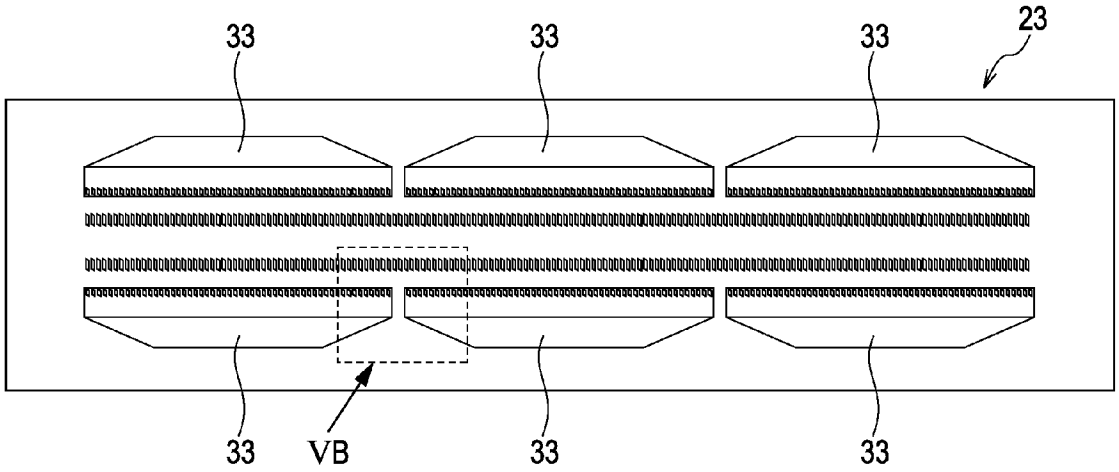
FIG. 5A is a bottom view of a communication substrate.
Figure 5B:
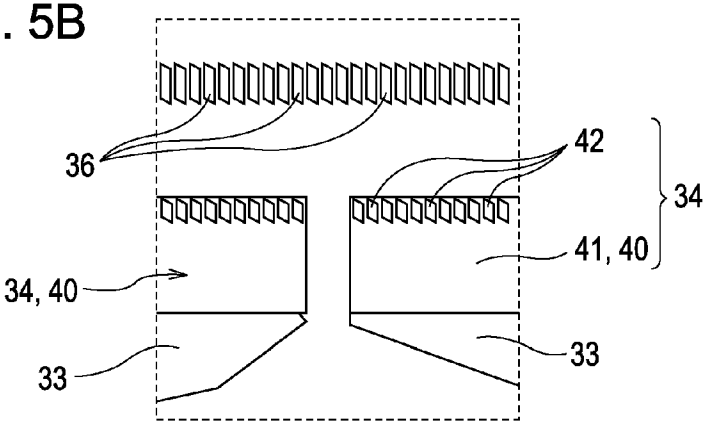
FIG. 5B is an enlarged view of an area VB in FIG. 5A.

FIGS. 5A and 5B are diagrams illustrating a configuration of the communication substrate 23. FIG. 5A is a plan view of a surface (a bottom surface) of the communication substrate 23 to which the nozzle plate 22 and the compliance sheet 25 are to be bonded. FIG. 5B is an enlarged view of an area VB in FIG. 5A. The communication substrate 23 is a plate-shaped member made of a silicon substrate. In the communication substrate 23, the empty liquid chamber portions 33, which are to be portions of the common liquid chambers 32, are formed by anisotropic etching so as to pass through the communication substrate 23 in the thickness direction thereof. In the communication substrate 23, the empty liquid chamber portions 33, that is, three empty liquid chamber portions 33 in the embodiment, are formed for one nozzle row in the direction of the nozzle row (the first direction). This enables several different types of inks to be allocated to one nozzle row. Since two nozzle rows are formed in the nozzle plate 22 in the embodiment, a total of six empty liquid chamber portions 33 are formed in the communication substrate 23.

In addition, in the communication substrate 23, the supply-side communication paths 34 are formed for the respective empty liquid chamber portions 33 at positions adjacent to inner sides of the empty liquid chamber portions 33 in the second direction (sides which are toward the center). Each supply-side communication path 34 is a flow path that allows communication between the corresponding empty liquid chamber portion 33 (common liquid chamber 32) and the corresponding pressure chamber 31 of the pressure chamber forming substrate 29. Each supply-side communication path 34 includes a common communication path 41 that is formed by performing half etching from the bottom surface of the communication substrate 23 (i.e., a surface opposite a surface which is bonded to the unit case 26) to halfway through the communication substrate 23 in the thickness direction of the communication substrate 23, and individual communication paths 42 that pass through the communication substrate 23. Each of the common communication paths 41 is a cavity that is formed along the corresponding empty liquid chamber portion 33 and has a rectangular shape when viewed in plan. A first end portion of each common communication path 41 in the second direction communicates with the corresponding empty liquid chamber portion 33, whereas a second end portion thereof in the same direction is formed at a position which corresponds to a position of the corresponding pressure chamber 31 of the pressure chamber forming substrate 29 which is bonded to the communication substrate 23. The individual communication paths 42 are formed in the second end portions of the common communication paths 41 corresponding to the pressure chambers 31 of the pressure chamber forming substrate 29 along the first direction. A lower end of each individual communication path 42 communicates with the corresponding common communication path 41, and an upper end of each individual communication path 42 communicates with the corresponding pressure chamber 31 of the pressure chamber forming substrate 29 which is bonded to the communication substrate 23. In the communication substrate 23, upper surfaces of portions (thin portions 40 which are not half-etched) that correspond to the common communication paths 41 function as first bonding margins 43 (see FIG. 4) when the communication substrate 23 and the unit case 26 are bonded together. Details of this matter will be described later.

The empty liquid chamber portions 33 and the supply-side communication paths 34 are open at locations that are outwardly separated from bonded portions which are bonded to the nozzle plate 22 in the second direction on the bottom surface of the communication substrate 23. The openings of the empty liquid chamber portions 33 and the supply-side communication paths 34 are sealed with the compliance sheet 25. The compliance sheet 25 is a thin sheet material made of synthetic resin or metal that has flexibility. The compliance sheet 25 functions as a compliance portion that absorbs pressure fluctuations of inks in the common liquid chambers 32.

Figure 6:
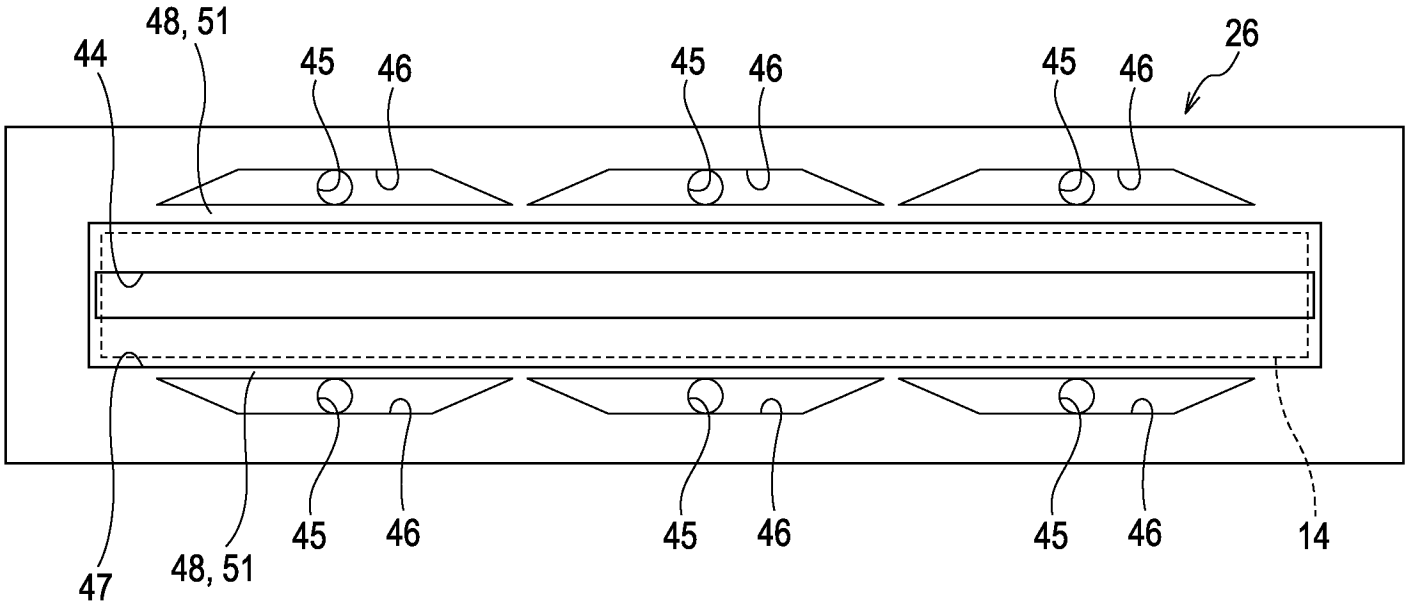
FIG. 6 is a bottom view of a unit case.
Figure 7A:
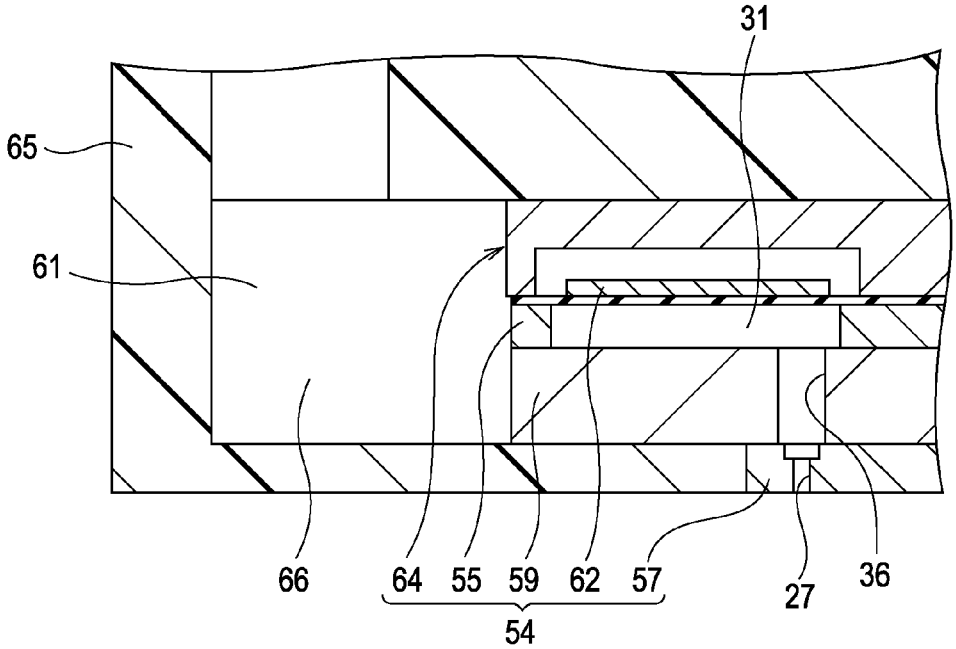
FIGS. 7A and 7B are schematic diagrams showing an exemplary configuration of a liquid ejecting head of the related art.
Figure 7B:
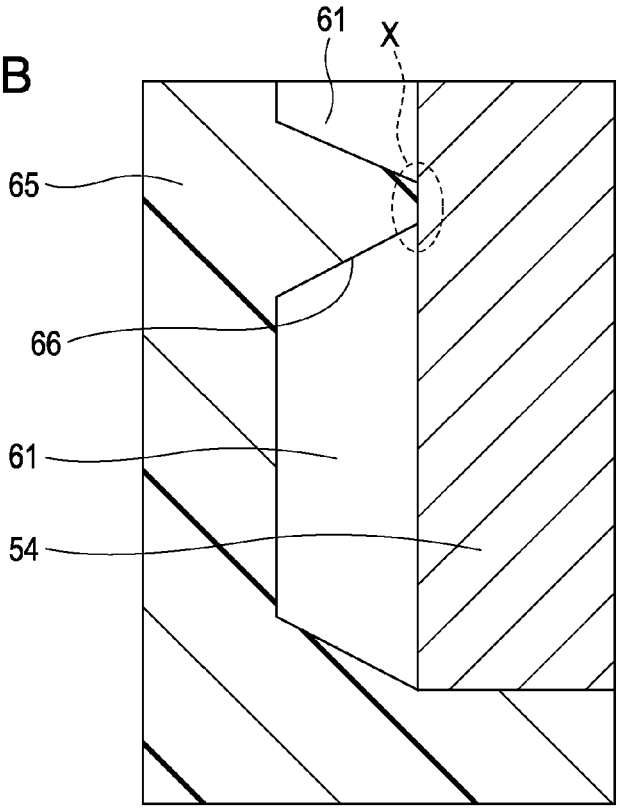

FIG. 6 is a plan view of the bottom surface of the unit case 26 (a surface to which the communication substrate 23 of the flow path unit 21 is bonded). The unit case 26 is a box-shaped member made of synthetic resin. The communication substrate 23 to which the nozzle plate 22, the compliance sheet 25, and the pressure generating unit 14 are bonded is fixed on the bottom surface of the unit case 26. In a center portion of the unit case 26 in plan view, an empty pass-through portion 44 that includes a rectangular opening having a length along the nozzle row direction is formed in a state of passing through the unit case 26 in the height direction of the unit case 26. The empty pass-through portion 44 communicates with an empty wiring portion 38 of the pressure generating unit 14 so as to form an empty portion in which the one end portion of the flexible cable 49 and the driver IC 50 are accommodated. On the bottom surface of the unit case 26, an empty accommodating portion 47 that is recessed from the bottom surface of the unit case 26 to halfway through the unit case 26 in the height direction of the unit case 26 is formed. The depth of the empty accommodating portion 47 is set to be slightly greater than the thickness (the height) of the pressure generating unit 14. In addition, the dimensions of the empty accommodating portion 47 in the first and second directions are set to be slightly greater than those of the pressure generating unit 14 in the same directions. When the flow path unit 21 is positioned on and bonded to the bottom surface of the unit case 26, the pressure generating unit 14 which is stacked on the communication substrate 23 is accommodated in the empty accommodating portion 47. A lower end of the above-described empty pass-through portion 44 is open to a ceiling surface of the empty accommodating portion 47.

Empty liquid chamber forming portions 46 and ink injection paths 45 are formed in the unit case 26. The empty liquid chamber forming portions 46 are formed in the unit case 26 at positions that are outwardly separated from the empty accommodating portion 47 in the second direction with partition walls 48 therebetween. More specifically, a total of six empty liquid chamber forming portions 46, three of which are formed at both sides of the empty accommodating portion 47, are formed so as to correspond to the empty liquid chamber portions 33 of the communication substrate 23. In the case where the communication substrate 23 is bonded to the unit case 26, each empty liquid chamber forming portion 46 communicates with the corresponding empty liquid chamber portion 33 so as to define the common liquid chamber 32. The partition walls 48 that separate the empty liquid chamber forming portions 46 from the empty accommodating portion 47 are formed at positions corresponding to the positions of the first bonding margins 43 of the communication substrate 23. Surfaces of the partition walls 48 that face the first bonding margins 43 function as second bonding margins 51 (see FIG. 4). Each of the ink injection paths 45 is a flow path provided for the corresponding empty liquid chamber forming portion 46. An upper end of each ink injection path 45 is open to the upper surface of the unit case 26, and a lower end of each ink injection path 45 is open to the corresponding empty liquid chamber forming portion 46. The ink from the ink cartridge 7 is injected into the empty liquid chamber forming portions 46 (the common liquid chambers 32) through the ink injection paths 45.

In the case of manufacturing the above-described head unit 16, first, the elastic film 30 and the insulating film are formed on the upper surface of the pressure chamber forming substrate 29 (a silicon substrate without the pressure chambers 31 formed therein), and after that, the piezoelectric elements 35 are formed by firing. The protective substrate 24 is bonded to the top of this so that each piezoelectric element 35 is accommodated in the corresponding clearance concave portion 39. Then, in this state, the pressure chambers 31 are formed by anisotropic etching performed from the bottom surface of the pressure chamber forming substrate 29. As described above, by stacking the piezoelectric elements 35 and the protective substrate 24 on the upper surface of the pressure chamber forming substrate 29 and integrating them before forming the pressure chambers 31 in the pressure chamber forming substrate 29, breakage of the pressure chamber forming substrate 29 during an assembly process of the pressure generating unit 14 will be prevented.

Next, the nozzle plate 22 is bonded to the bottom surface of the communication substrate 23 by using an adhesive with each nozzle communication path 36 and the corresponding nozzles 27 communicating with each other. In addition, the compliance sheet 25 is bonded to the bottom surface of the communication substrate 23 in a state of sealing the openings of the empty liquid chamber portions 33 and the supply-side communication paths 34. This is how the flow path unit 21 is integrated. Subsequently, the above-described pressure generating unit 14 is bonded to the upper surface of the communication substrate 23 of the flow path unit 21. In particular, the pressure chamber forming substrate 29 of the pressure generating unit 14 is bonded to the upper surface of the communication substrate 23 by using an adhesive with the first end portion and the second end portion of each pressure chamber 31 communicating with the corresponding nozzle communication path 36 and the corresponding individual communication path 42 of the corresponding supply-side communication path 34, respectively.

Once the flow path unit 21 and the pressure generating unit 14 are assembled together, the flexible cable 49 is wired to the electrode terminals of the piezoelectric elements 35 via the empty wiring portion 38 of the protective substrate 24. In other words, terminals at the one end of the flexible cable 49 are electrically connected to portions that correspond to the electrode terminals of the piezoelectric elements 35.

Following this, the communication substrate 23 of the flow path unit 21 and the unit case 26 are bonded together by using an adhesive. In particular, the upper surface of the communication substrate 23 including the above-described first bonding margins 43 and the bottom surface of the unit case 26 including the second bonding margins 51 are bonded together by using an adhesive. Thus, the first bonding margins 43 and the second bonding margins 51 are bonded together. When the flow path unit 21 and the unit case 26 are bonded together, the pressure generating unit 14 is accommodated in the empty accommodating portion 47 and each empty liquid chamber forming portion 46 and the corresponding empty liquid chamber portion 33 communicate with each other in a liquid-tight state so that a plurality of common liquid chambers 32 (a total of six common liquid chambers 32 in the embodiment) are defined as empty portions that are independent of one another. The one end of the flexible cable 49 and the driver IC 50 are accommodated in the empty pass-through portion 44 of the unit case 26. As a result, the head unit 16 is fabricated. Then common flow paths each of which is a series of paths from one of the ink injection paths 45 to the common communication path 41 of the corresponding supply-side communication path 34 via the corresponding common liquid chamber 32, and individual flow paths each of which is a path from one of the individual communication paths 42 of the supply-side communication paths 34 to the corresponding nozzle 27 via the corresponding pressure chamber 31 and nozzle communication path 36, are formed inside the head unit 16.

As described above, in the head unit 16 which employs the above-described configuration, the supply-side communication paths 34 are formed by performing half etching from the bottom surface of the communication substrate 23 to halfway through the communication substrate 23 in the thickness direction of the communication substrate 23 with the thin portions 40 left on the upper surface side of the communication substrate 23. The upper surfaces of the thin portions 40 serve as the first bonding margins 43. The empty accommodating portion 47 and the empty liquid chamber forming portions 46 are separated by the partition walls 48 in the unit case 26. The bottom surfaces of the partition walls 48 serve as the second bonding margins 51. Thus, in the case of reducing the size of the pressure generating unit 14 in a configuration in which a plurality of common liquid chambers 32 are provided for one nozzle row in the nozzle row direction, the plurality of common liquid chambers 32 which are independent of one another can be defined by bonding the upper surface of the communication substrate 23 including the first bonding margins 43 and the bottom surface of the unit case 26 including the second bonding margins 51 together without bonding side surfaces of walls that partition the common liquid chambers 32 which are adjacent to one another in the first direction to a side surface of the pressure generating unit 14. As a result, also in a configuration in which a plurality of common liquid chambers 32 are provided for one nozzle row in the nozzle row direction, ink leakage between the common liquid chambers 32 can be prevented, and the pressure generating unit 14, particularly, the pressure chamber forming substrate 29 made of a silicon substrate can be reduced in size, resulting in a reduction in the overall cost of the head unit 16.

The invention is not limited to the above-described embodiment, and various modifications can be made within the scope of the claims.

For example, while an exemplary configuration in which the compliance sheet 25 on the bottom surface of the communication substrate 23 functions as a compliance portion that absorbs pressure fluctuations in the common liquid chambers 32 is described in the above embodiment, it is not intended that the invention be limited thereto. In other words, the compliance portion may be arranged at a location where it can absorb pressure fluctuations in the common liquid chambers 32, and for example, the compliance portion may be arranged at a location adjacent to the empty liquid chamber forming portions 46 in the unit case 26. In this case, a configuration in which the empty liquid chamber portion 33 and the supply-side communication path 34 in the communication substrate 23 are not open to the bottom surface of the communication substrate 23 (a configuration in which the empty liquid chamber portion 33 and the supply-side communication path 34 are formed from the upper surface side of the communication substrate 23 to halfway through the communication substrate 23 in the thickness direction of the communication substrate 23) can be employed. Alternatively, a configuration in which the empty liquid chamber portion 33 and the supply-side communication path 34 in the communication substrate 23 are open to the bottom surface of the communication substrate 23 and the openings are sealed with the nozzle plate 22 can also be employed. In this configuration, dimensions of the nozzle plate 22 are set to be large enough that the entire bottom surface of the communication substrate 23 is generally covered.

Note that while the piezoelectric element 35 of a so-called flexural vibration type is used as an example of a pressure generator in the above-described embodiment, it is not intended that the invention be limited thereto, and for example, a piezoelectric element of a so-called longitudinal vibration type can also be employed. Furthermore, the invention can be applied to a configuration in which a pressure generator such as a heating device that causes pressure fluctuations by generating bubbles in the ink with its heat or an electrostatic actuator that causes pressure fluctuations by displacing partition walls of a pressure chamber with its electrostatic force is employed.

While the ink jet recording head 3 (the head unit 16) which is a type of liquid ejecting head is used as an example in the above description, the invention can also applied to other liquid ejecting heads that employ a configuration in which a pressure generating unit and a flow path unit are fixed to a unit case. For example, the invention can applied to color material ejecting heads that are used for manufacturing color filters for liquid crystal displays or the like, electrode material ejecting heads that are used for forming electrodes for organic electro luminescence (EL) displays, field emission displays (FED) or the like, living organic material ejecting heads that are used for manufacturing biochips, and the like.

What is claimed is:

1. A liquid ejecting head comprising:

a nozzle forming member defining a nozzle;

a pressure chamber forming substrate defining a pressure chamber;

a pressure generator corresponding to the pressure chamber;

a communication member provided between the nozzle forming member and the pressure chamber forming substrate and in which are formed a nozzle communication path that allows communication between the pressure chamber and the nozzle, an empty liquid chamber portion forming a part of a common liquid chamber, and supply-side communication path that allows communication between the empty liquid chamber portion and the pressure chamber, the communication member further including a individual communication path; and a case member that is bonded to the communication member and is disposed at a position outward from the pressure chamber forming substrate relative to the pressure chamber;

wherein the case member is bonded to the pressure chamber size of the communication member.

2. The liquid ejecting head according to claim 1, wherein a dimension of the nozzle forming member in a direction corresponding to a length of the pressure chamber is smaller than a dimension of the communication member in the direction.

3. The liquid ejecting head according to claim 2, wherein the empty liquid chamber portions in the communication member has an opening in a surface of the communication member at a location separated from a portion which is bonded to the nozzle forming member, and wherein the opening is sealed with a compliance member having flexibility.

4. The liquid ejecting head according to claim 1, wherein the case member is made of synthetic resin, and the pressure chamber forming substrate, the nozzle forming member and the communication member are made of silicon.

5. A liquid ejecting apparatus comprising:

the liquid ejecting head according to claim 1.

6. A liquid ejecting apparatus comprising:

the liquid ejecting head according to claim 2.

7. A liquid ejecting apparatus comprising:

the liquid ejecting head according to claim 3.

8. A liquid ejecting apparatus comprising:

the liquid ejecting head according to claim 4.

* * * * *